US011499326B2

(12) United States Patent
Lee

(10) Patent No.: US 11,499,326 B2
(45) Date of Patent: Nov. 15, 2022

(54) JOINT COMPOUND APPLICATION ASSEMBLY

(71) Applicant: Hosang Lee, Brooklyn, NY (US)

(72) Inventor: Hosang Lee, Brooklyn, NY (US)

( * ) Notice: Subject to any disclaimer, the term of this patent is extended or adjusted under 35 U.S.C. 154(b) by 636 days.

(21) Appl. No.: 16/561,696

(22) Filed: Sep. 5, 2019

(65) Prior Publication Data

US 2021/0071431 A1 Mar. 11, 2021

(51) Int. Cl.
*E04F 21/02* (2006.01)
*E04F 21/165* (2006.01)
*E04F 21/16* (2006.01)

(52) U.S. Cl.
CPC ..... *E04F 21/026* (2013.01); *E04F 21/16* (2013.01); *E04F 21/1657* (2013.01)

(58) Field of Classification Search
CPC ..... E04F 21/026; E04F 21/16; E04F 21/1657; E04F 21/12; E04F 21/165; E04F 21/1655; E04F 21/08; E04F 21/0652
See application file for complete search history.

(56) References Cited

U.S. PATENT DOCUMENTS 2,502,499 A * 4/1950 Ames ..... E04F 21/026 401/5
2,597,573 A 5/1952 De Groff
2,815,142 A * 12/1957 Ames ..... E04F 21/1657 156/575
2,858,953 A * 11/1958 Harrell ..... E04F 21/165 156/577
3,007,837 A * 11/1961 Goode, Jr. ..... E04F 21/026 156/577
3,116,195 A * 12/1963 Castle ..... E04F 21/026 156/575
3,188,262 A * 6/1965 Torrison ..... E04F 21/1657 156/461
3,260,638 A * 7/1966 Hoveland ..... E04F 21/165 156/461
3,707,427 A * 12/1972 Erickson ..... E04F 21/026 118/410
4,086,121 A * 4/1978 Ames ..... B44C 7/06 156/577
4,105,490 A * 8/1978 Lass ..... B44C 7/06 156/577
4,127,434 A * 11/1978 Lass ..... E04F 21/026 156/575
4,452,663 A * 6/1984 Heaton ..... E04F 21/1657 156/577
4,652,331 A * 3/1987 Plasencia ..... E04F 21/1655 156/577

(Continued)

FOREIGN PATENT DOCUMENTS

WO WO2009137841 11/2009

*Primary Examiner* — James M Ference

(57) ABSTRACT

A joint compound application assembly for applying joint compound on drywall includes a rod that has a conduit integrated therein. The conduit is fluidly coupled to a source of joint compound thereby facilitating the joint compound to be urged through the conduit. A box is coupled to the rod and the box has a bottom end that is open into an interior of the box. A spray bar is fluidly coupled to the conduit and the spray bar is directed toward the bottom end of the box to spray the joint compound onto a wall or ceiling. A knife is coupled to the box to smooth the joint compound on the wall or ceiling.

10 Claims, 8 Drawing Sheets

(56) References Cited

U.S. PATENT DOCUMENTS 4,689,107 A * 8/1987 Entwistle ..... E04F 21/026 156/577
4,767,056 A * 8/1988 Demetrius ..... B05B 12/18 239/290
4,775,442 A * 10/1988 Januska ..... E04F 21/1655 156/577
4,828,647 A * 5/1989 Eccleston ..... E04F 21/1657 156/577
5,013,389 A * 5/1991 Retti ..... E04F 21/1655 156/577
5,114,527 A * 5/1992 Stern ..... E04F 21/026 156/577
5,230,608 A * 7/1993 Januska ..... E04F 21/026 156/578
5,240,500 A * 8/1993 Retti ..... E04F 21/00 106/778
5,535,926 A * 7/1996 Blitz ..... B05C 17/002 417/570
5,545,287 A * 8/1996 Carlson ..... E04F 21/1652 156/577
5,671,321 A * 9/1997 Bagnuolo ..... A45D 20/122 392/383
5,794,855 A * 8/1998 Ledford ..... B05B 12/36 239/104
5,902,451 A * 5/1999 O'Mara ..... E04F 21/165 156/575
6,021,584 A * 2/2000 Schwartz ..... F26B 21/004 34/666
6,116,769 A * 9/2000 DeWall ..... B28C 7/163 366/65
6,205,679 B1 * 3/2001 Rodway ..... F26B 21/001 34/90
6,286,228 B1 * 9/2001 Bodnar ..... B08B 3/026 134/123
6,294,034 B1 * 9/2001 O'Mara ..... E04F 21/026 156/577
6,299,686 B1 * 10/2001 Mills ..... F04B 43/10 92/92
6,419,773 B1 * 7/2002 Lauermann ..... E04F 21/165 156/577
6,712,238 B1 * 3/2004 Mills ..... E04F 21/1657 222/61
7,621,309 B1 * 11/2009 Mondloch ..... E04F 21/026 156/577
7,624,782 B2 * 12/2009 Jungklaus ..... B65H 35/0053 156/577
7,954,535 B2 * 6/2011 Ross ..... E04F 21/026 156/577
9,387,503 B2 * 7/2016 Santiago ..... B05B 12/36
10,697,188 B2 * 6/2020 Telleria ..... E04F 21/165
10,718,119 B2 * 7/2020 Telleria ..... B05D 3/067
10,822,814 B2 * 11/2020 Telleria ..... B24B 7/182
10,870,996 B2 * 12/2020 Telleria ..... B24B 55/06
2002/0020345 A1 * 2/2002 Kormos ..... E04F 21/026 118/123
2002/0020482 A1 * 2/2002 O'Mara ..... E04F 21/026 156/577
2003/0138569 A1 * 7/2003 Dillinger ..... E04F 21/1657 156/577
2004/0159406 A1 * 8/2004 Jungklaus ..... E04F 21/165 156/577
2004/0216847 A1 * 11/2004 Hall ..... E04F 21/1655 156/577
2004/0244916 A1 * 12/2004 Hall ..... E04F 21/1655 156/574
2005/0061449 A1 * 3/2005 Jungklaus ..... E04F 21/026 156/577
2006/0219366 A1 * 10/2006 Smythe ..... E04F 21/026 156/577
2010/0014908 A1 * 1/2010 Campbell ..... B05C 17/0308 401/146
2011/0081479 A1 * 4/2011 Morris, Jr. ..... B05B 15/625 118/100
2018/0283015 A1 * 10/2018 Telleria ..... B25J 9/1697
2018/0283019 A1 * 10/2018 Telleria ..... B25J 15/0019
2018/0328052 A1 * 11/2018 Murray ..... E04F 21/12
2019/0010713 A1 * 1/2019 Negri ..... E04F 21/06
2019/0383037 A1 * 12/2019 Kloster ..... E04F 21/08
2021/0071431 A1 * 3/2021 Lee ..... E04F 21/16

* cited by examiner

JOINT COMPOUND APPLICATION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to application devices and more particularly pertains to a new application device for applying joint compound on drywall.

(2) Description of Related Art Including Information Disclosed Under 37 CFR 1.97 and 1.98

The prior art relates to application devices.

BRIEF SUMMARY OF THE INVENTION

An embodiment of the disclosure meets the needs presented above by generally comprising a rod that has a conduit integrated therein. The conduit is fluidly coupled to a source of joint compound thereby facilitating the joint compound to be urged through the conduit. A box is coupled to the rod and the box has a bottom end that is open into an interior of the box. A spray bar is fluidly coupled to the conduit and the spray bar is directed toward the bottom end of the box to spray the joint compound onto a wall or ceiling. A knife is coupled to the box to smooth the joint compound on the wall or ceiling.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
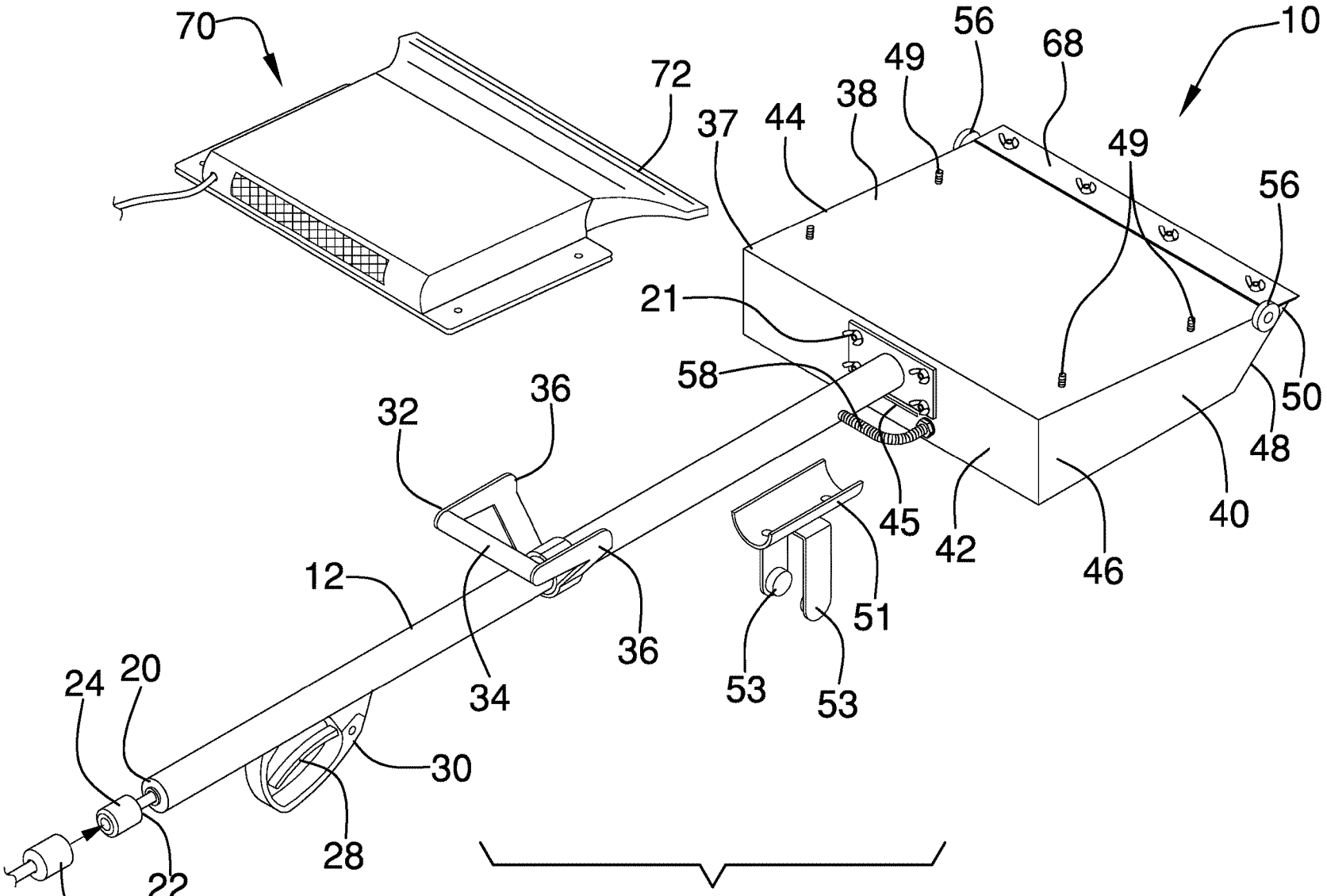
FIG. 1 is a perspective view of a joint compound application assembly according to an embodiment of the disclosure.
Figure 2:
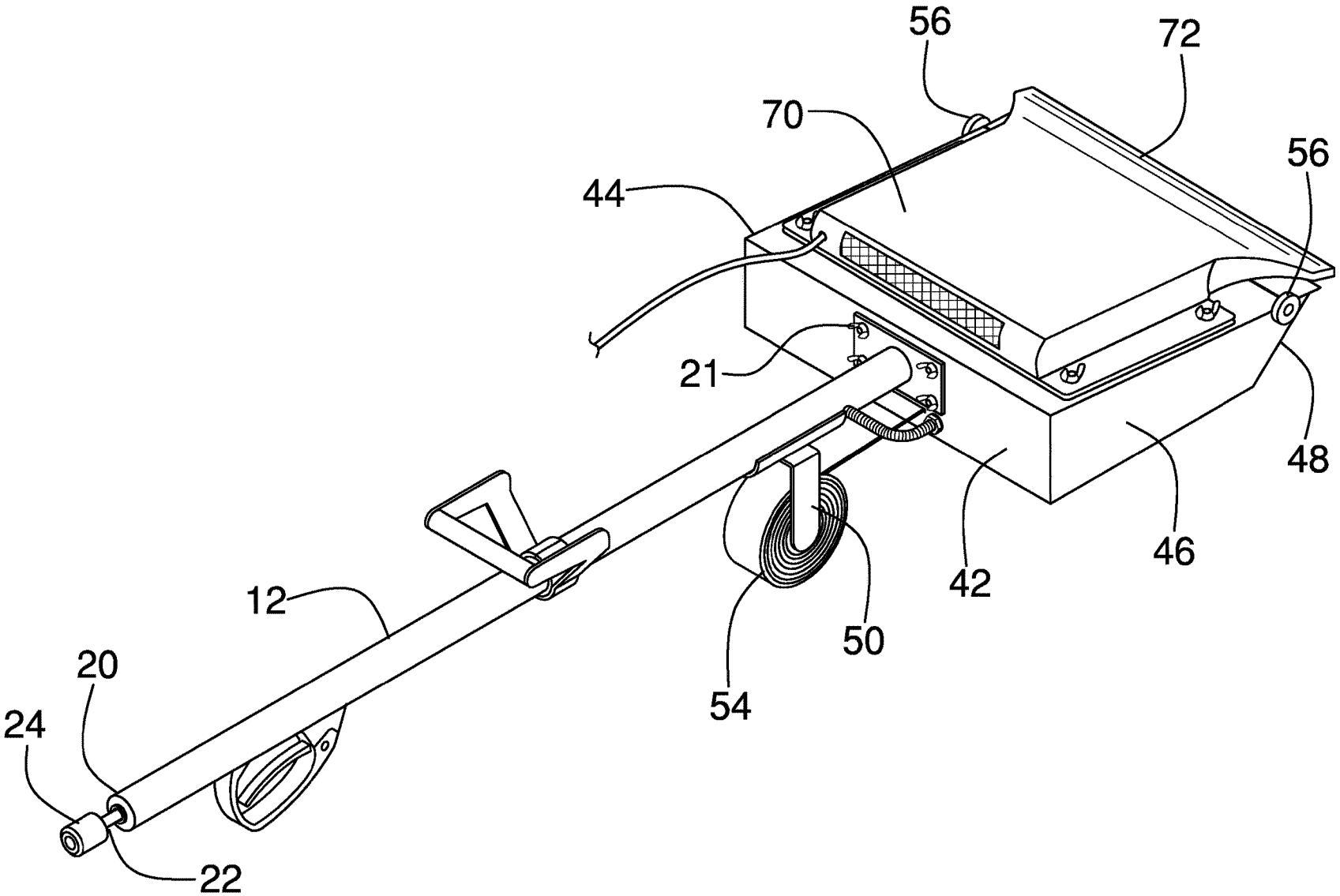
FIG. 2 is a top perspective view of an embodiment of the disclosure.
Figure 3:
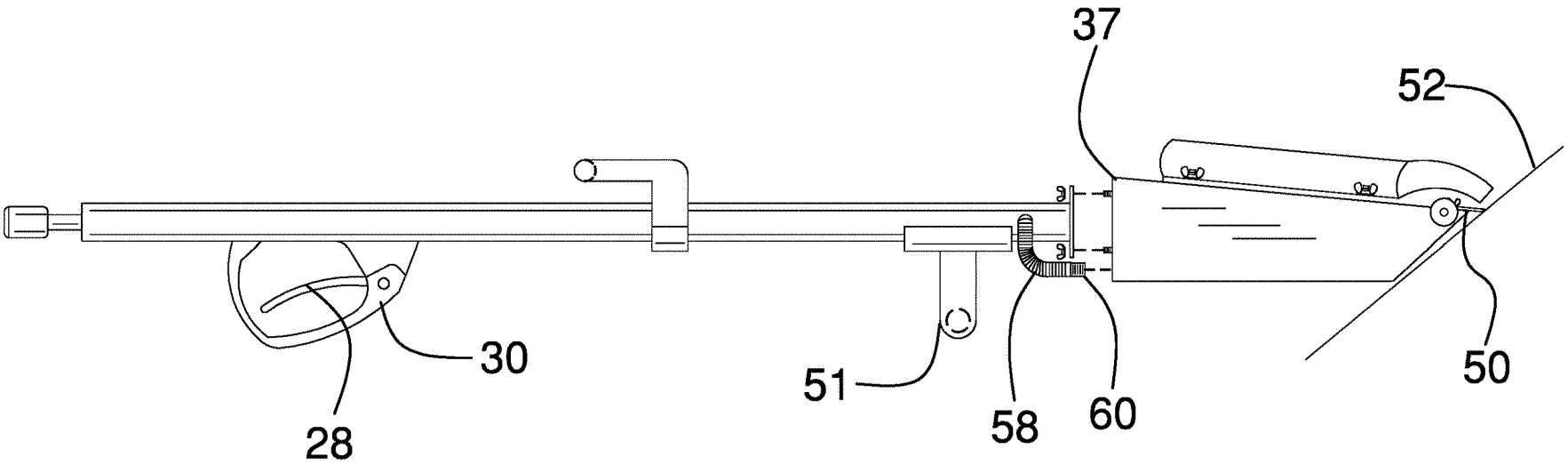
FIG. 3 is a right side exploded view of an embodiment of the disclosure.
Figure 4:
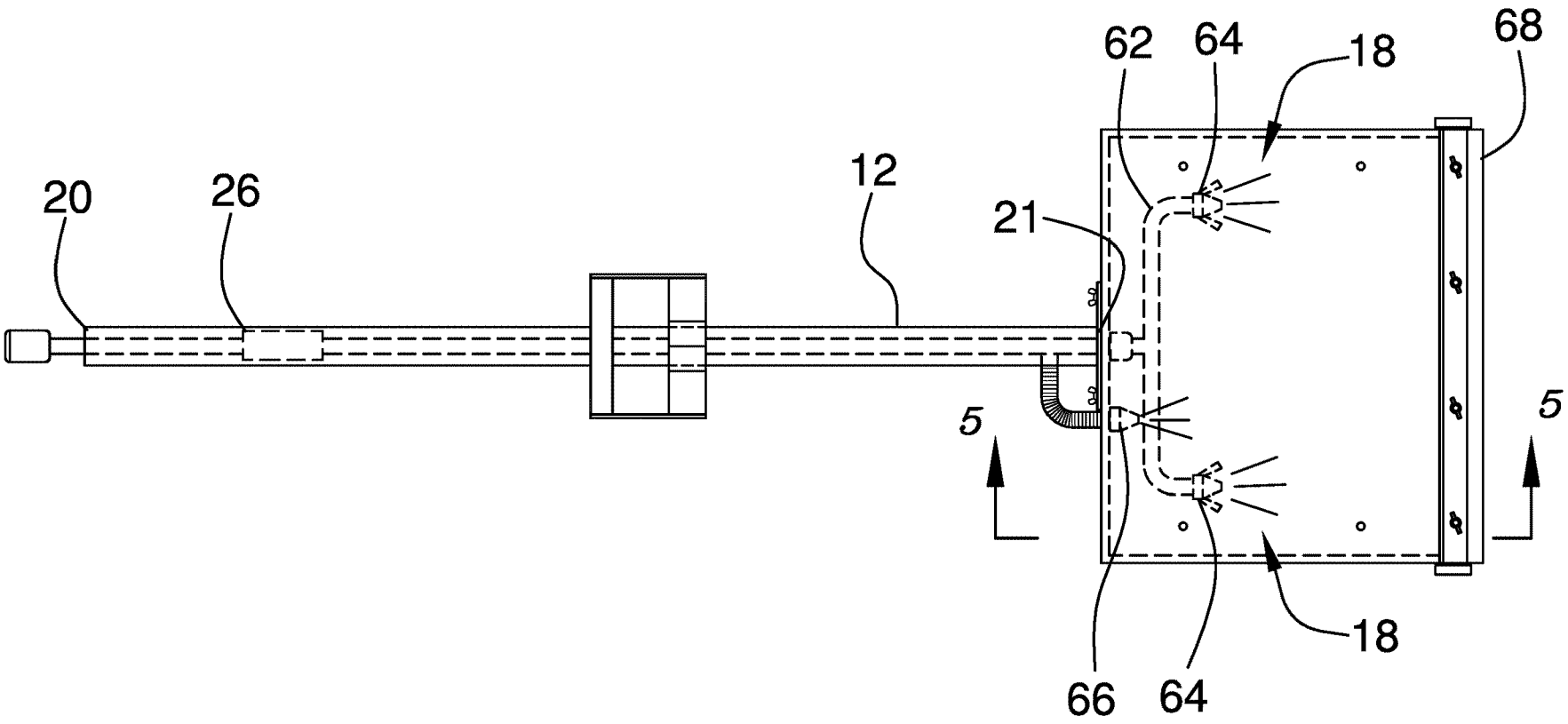
FIG. 4 is a top phantom view of an embodiment of the disclosure.
Figure 5:
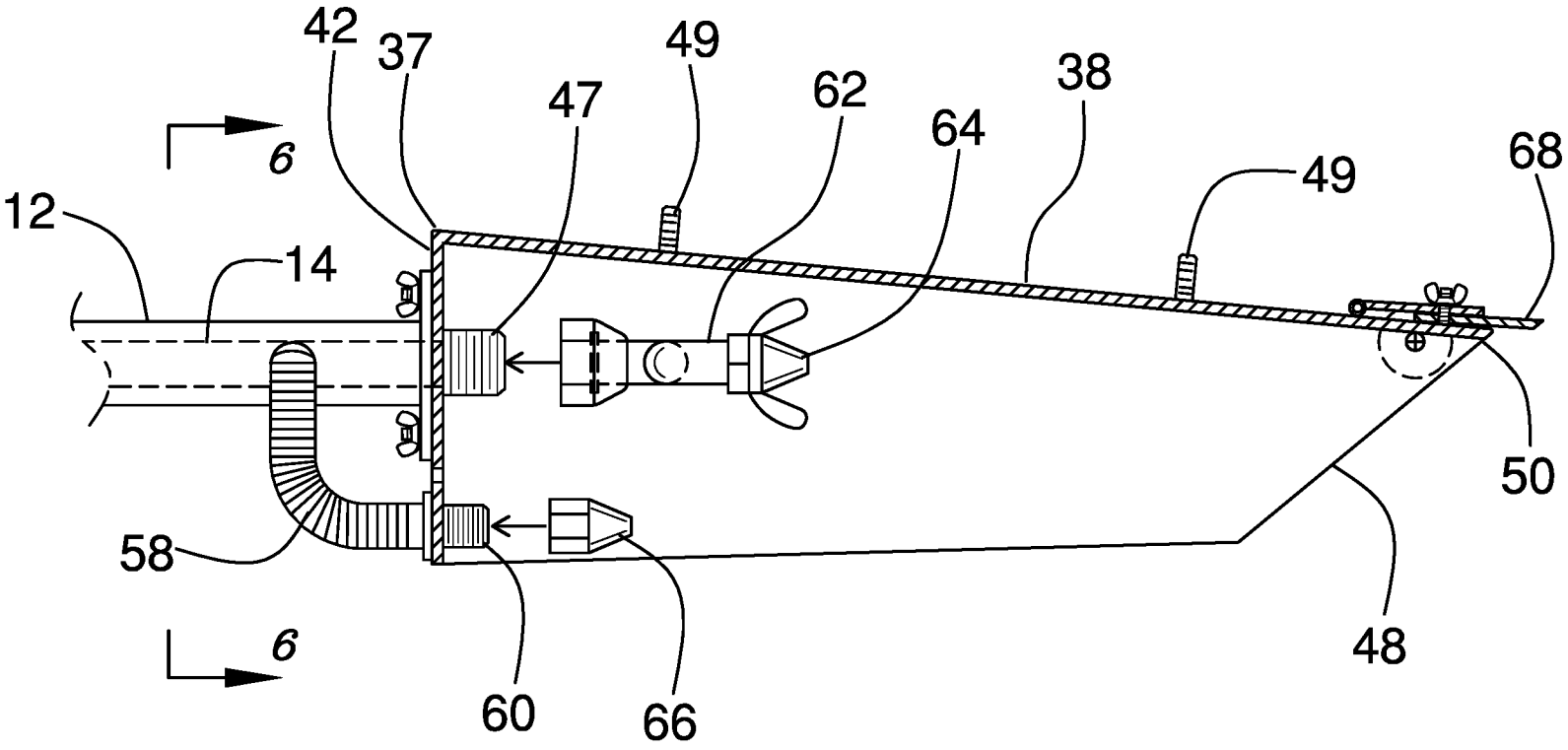
FIG. 5 is a cross sectional view taken along line 5-5 of FIG. 4 of an embodiment of the disclosure.
Figure 6:
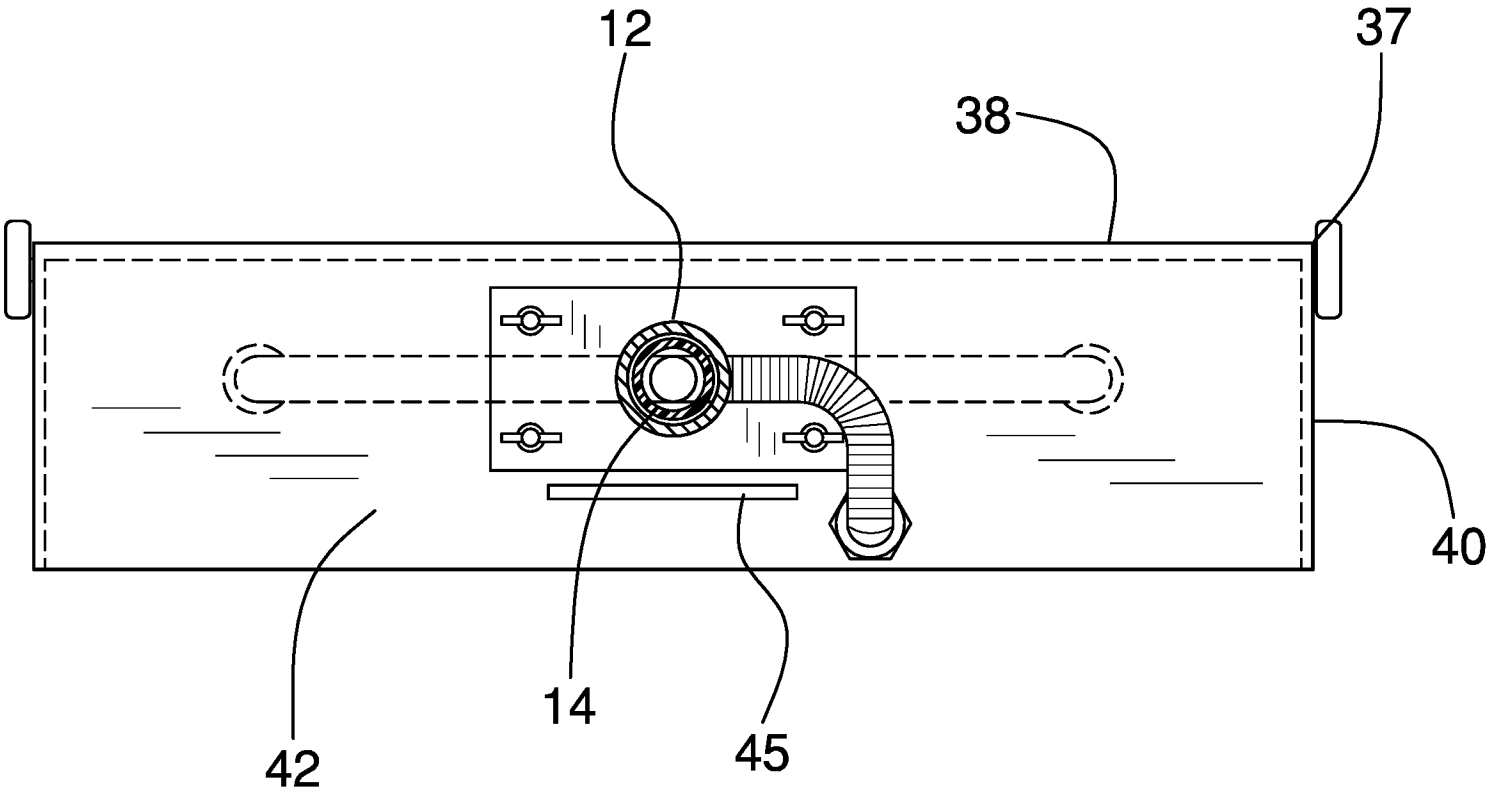
FIG. 6 is a cross sectional view taken along line 6-6 of FIG. 5 of an embodiment of the disclosure.
Figure 7:
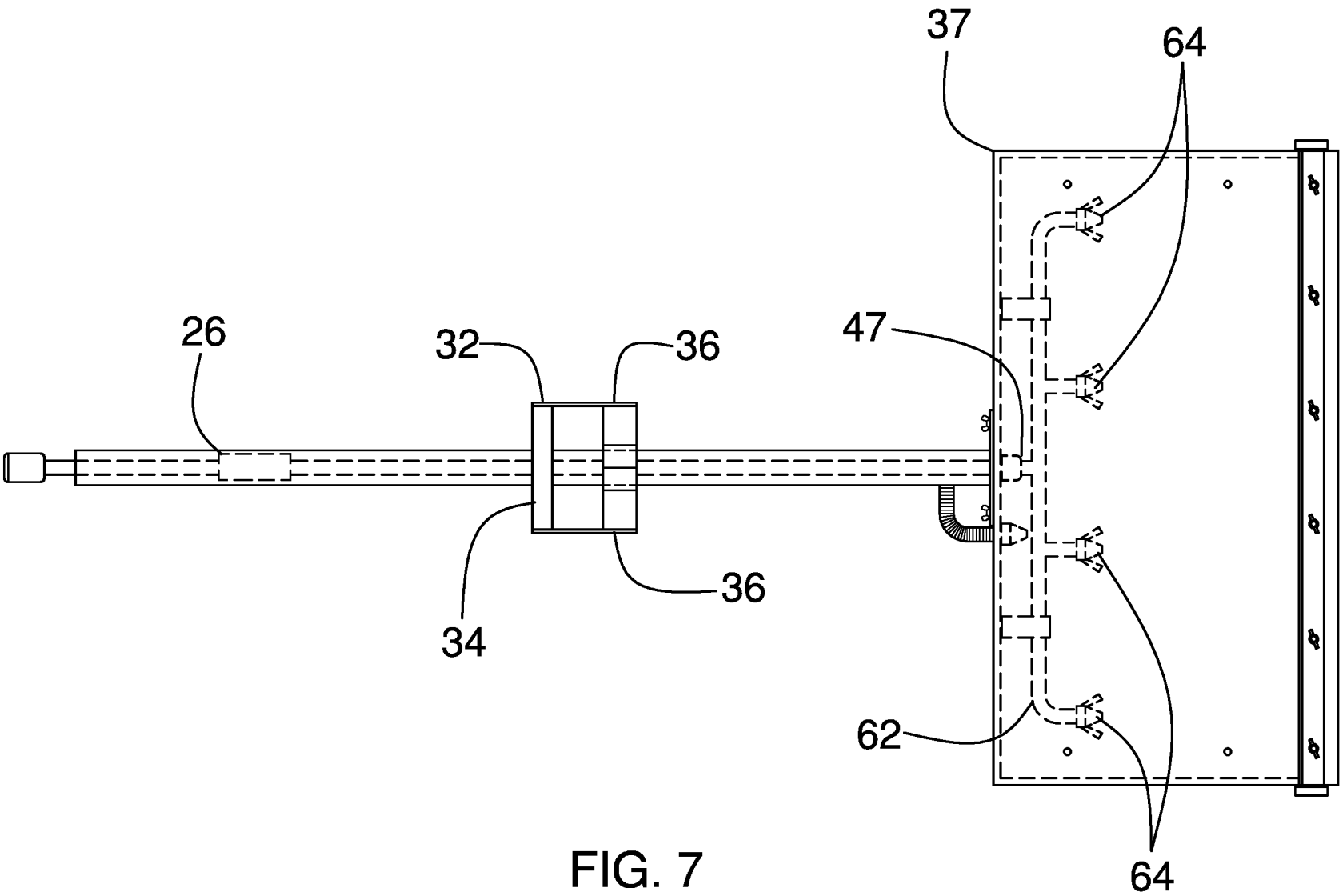
FIG. 7 is a top phantom view of an embodiment of the disclosure.
Figure 8:
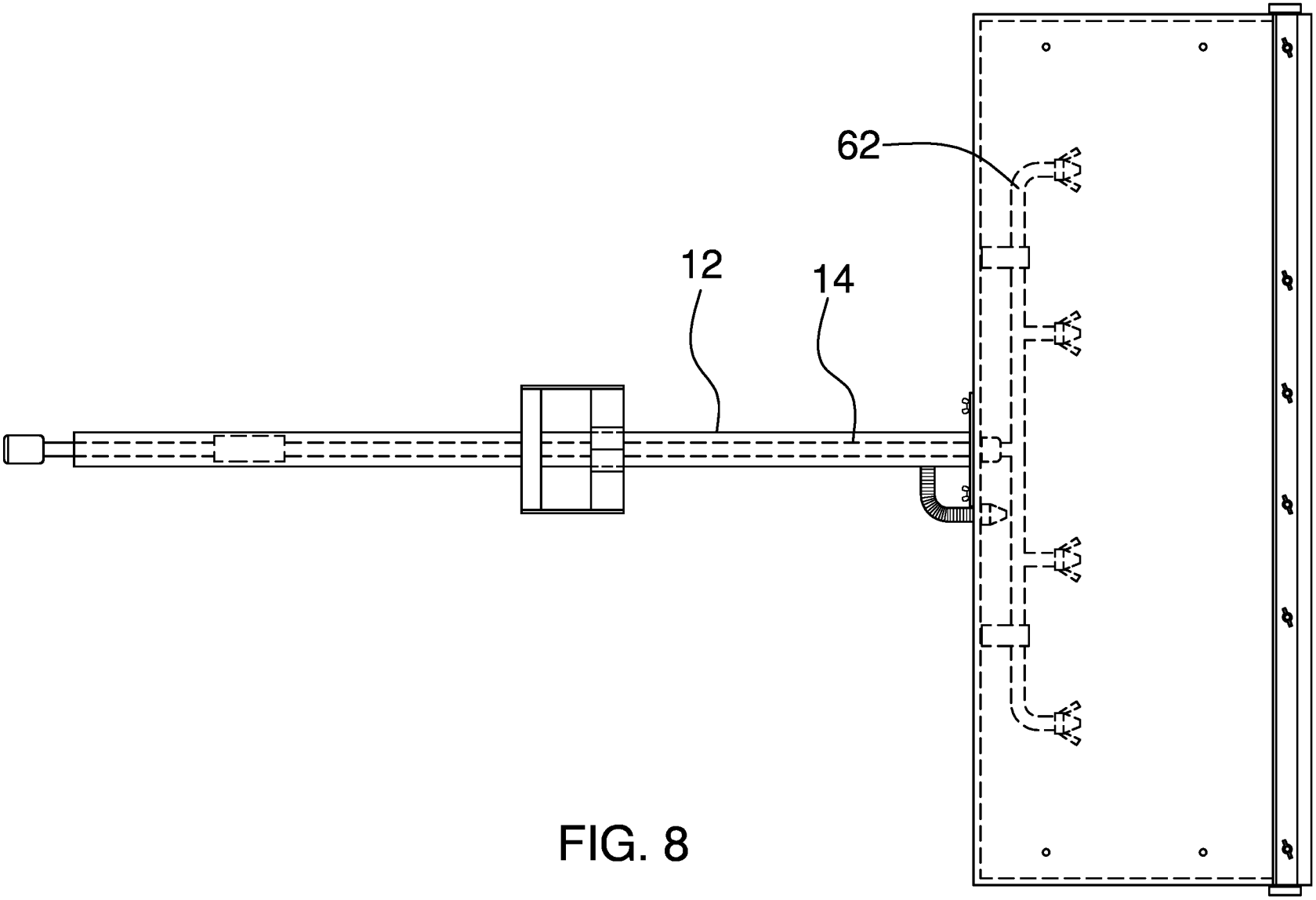
FIG. 8 is a top phantom view of an embodiment of the disclosure.

With reference now to the drawings, and in particular to FIGS. 1 through 8 thereof, a new application device embodying the principles and concepts of an embodiment of the disclosure and generally designated by the reference numeral 10 will be described.

As best illustrated in FIGS. 1 through 8, the joint compound application assembly 10 generally comprises a rod 12 that has a conduit 14 integrated therein. The conduit 14 is fluidly coupled to a source of joint compound 16 thereby facilitating the joint compound 18 to be urged through the conduit 14. The source of joint compound 16 may be an airless sprayer or the like and the joint compound 18 may be joint compound for gypsum board. The rod 12 has a first end 20 and a second end 21, and the rod 12 is elongated between the first end 20 and the second end 21. The conduit 14 has an input end 22 adjacent to the first end 20 and the input end 22 has a fitting 24 that is fluidly coupled thereto for removably engaging the source of the joint compound 16.

A valve 26 is coupled to the rod 12 and the valve 26 is in communication with the conduit 14. The valve 26 inhibits the joint compound 18 from passing through the conduit 14 when the valve 26 is closed. Additionally, the valve 26 facilitates the joint compound 18 to pass through the conduit 14 when the valve 26 is opened. A lever 28 is pivotally coupled to the rod 12 and the lever 28 is coupled to the valve 26. The lever 28 opens the valve 26 when the lever 28 is depressed and the lever 28 closes the valve 26 when the lever 28 is released. A guard 30 is positioned around the lever 28 thereby inhibiting the lever 28 from being inadvertently depressed.

A handle 32 is coupled to the rod 12 for gripping the handle 32. The handle 32 has a central member 34 extending between a pair of outward members 36. Each of the outward members 36 is coupled to the rod 12 having the central member 34 being spaced from the rod 12 for gripping.

A box 37 is provided and the box 37 is coupled to the rod 12. The box 37 has a top wall 38 and an outer wall 40 extending downwardly therefrom, and the outer wall 40 has a back side 42, a first lateral side 44 and a second lateral side 46. Each of first lateral side 44 and the second lateral side 46 has a sloped portion 48 that slopes upwardly toward the top wall 38 to define a front edge 50 of the box 37. The sloped portion 48 of each of the first lateral side 44 and the second lateral side 46 is positioned against a wall or ceiling 52.

The second end 21 of the rod 12 is coupled to the back side 42 of the outer wall 40 of the box 37. The back side 42 has a tape slot 45 extending into an interior of the box 37 and the tape slot 45 is positioned beneath the rod 12. The conduit 14 has an output end 47 and the output end 47 is positioned in the box 37. A plurality of fasteners 49 is provided and each of the fasteners 49 is coupled to and extends away from the top wall 38 of the box 37. A tape mount 51 is removably coupled to the rod 12. The tape mount 51 includes a pair of engagements 53 that each releasably engages a respective side of a roll of tape 54. The tape 54 is extendable through the tape slot 45 in the box 37 thereby facilitating the tape 54 to be applied to the wall or ceiling 52. The tape 54 may be joint tape for gypsum board.

A pair of rollers 56 is each rotatably coupled to the box 37. Each of the rollers 56 rolls along the wall or the ceiling thereby facilitating a bottom side of the box 37 to be directed toward the wall or ceiling 52. Each of the rollers 56 is positioned on a respective one of the first lateral side 44 and the second lateral side 46 of the outer wall 40 of the box 37. Each of the rollers 56 is positioned adjacent to an intersection between the sloped portion 48 of the respective first lateral side 44 and the second lateral side 46 and the top wall 38 of the box 37.

A hose 58 is fluidly coupled to the conduit 14 and the hose 58 extends between the rod 12 and the back side 42 of the outer wall 40 of the box 37. The hose 58 has a distal end 60 with respect to the rod 12 and the distal end 60 is positioned in the box 37 at a point that is located beneath the tape slot 45. A spray bar 62 is fluidly coupled to the conduit 14 to receive the joint compound 18. The spray bar 62 is fluidly coupled to the outlet end of the conduit 14 and the spray bar 62 has a plurality of outputs 64. Each of the outputs 64 is directed toward the front edge 50 of the box 37 to direct the joint compound 18 onto the wall or ceiling 52.

The outputs 64 are spaced apart from each other and are distributed between the first lateral side 44 and the second lateral side 46 of the outer wall 40 of the box 37. As is most clearly shown in FIG. 2, the spray bar 62 may have a pair of outputs 64. As is most clearly shown in FIGS. 7 and 8, the spray bar may have at least four outputs 64. Each of the outputs 64 may be high pressure spray nozzles of any conventional design.

A tape nozzle 66 is fluidly coupled to the distal end 60 of the hose 58. The tape nozzle 66 sprays the joint compound 18 over the tape 54 when the tape 54 is applied to the wall or ceiling 52. A knife 68 is coupled to the box 37 and the knife 68 positioned on the top wall 38 of the box 37. The knife 68 is coextensive with the front edge 50 of the box 37 to smooth the joint compound 18 on the wall or ceiling 52.

A heating unit 70 is removably coupled to the box 37 and heating unit 70 blows heated air onto the wall or ceiling 52 when the heating unit 70 is turned on. In this way the heating unit 70 enhances drying the joint compound 18 on the wall or ceiling 52. The heating unit 70 engages each of the fasteners 49 on the top wall 38 of the box 37. The heating unit 70 has an exhaust 72 and the exhaust 72 is directed toward the front edge 50 of the box 37 to direct the heated air onto the wall or ceiling 52. The heating unit 70 may comprise an electric heating unit 70 that includes an air blower and a heating element.

In use, the fitting 24 on the conduit 14 is fluidly coupled to the source of joint compound 16. The handle 32 on the rod 12 is gripped and the box 37 is positioned against the wall or ceiling 52. The tape is positioned on the tape mount 51 and the tape is inserted through the tape slot 45. The lever 28 is depressed to open the valve 26, thereby spraying the joint compound 18 onto the wall or ceiling 52, The box 37 is slid downwardly along the wall along a joint between panels of gypsum board. The tape is applied to the joint and the joint compound 18 is sprayed on top off and beneath the tape. Moreover, the knife 68 smooths the joint compound 18 as the box 37 is slid along the wall. In this way the joints between panels of gypsum board can be finished with the tape and the joint compound 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A joint compound application assembly being configured to apply joint compound and joint tape to a wall or a ceiling, said assembly comprising:

a rod having a conduit being integrated therein, said conduit being fluidly coupled to a source of joint compound thereby facilitating the joint compound to be urged through said conduit;

a box being coupled to said rod, said box having a bottom end being open into an interior of said box;

a hose being fluidly coupled to said conduit, said hose extending between said rod and said box;

a spray bar being fluidly coupled to said conduit wherein said spray bar is configured to receive the joint compound, said spray bar being directed toward said bottom end of said box wherein said spray bar is configured to spray the joint compound onto the wall or ceiling;

a knife being coupled to said box wherein said knife is configured to smooth the joint compound on the wall or ceiling; and a heating unit being removably coupled to said box, said heating unit blowing heated air onto the wall or ceiling when said heating unit is turned on wherein said heating unit is configured to enhance drying the joint compound on the wall or ceiling;

wherein said rod having a first end and a second end, said rod being elongated between said first end and said second end, said conduit having an input end adjacent to said first end, said input end having a fitting being fluidly coupled thereto for removably engaging the source of the joint compound; and wherein said box has a top wall and an outer wall extending downwardly therefrom, said outer wall having a back side, a first lateral side and a second lateral side, each of first lateral side and said second lateral side having a sloped portion sloping upwardly toward said top wall to define a front edge of said box said sloped portion of each of said first lateral side and said second lateral side being positioned against the wall or ceiling.

2. The joint compound application assembly according to claim 1, further comprising:

a valve being coupled to said rod, said valve being in communication with said conduit, said valve inhibiting the joint compound from passing through said conduit when said valve is closed, said valve facilitating the joint compound to pass through said conduit when said valve is opened; and a lever being pivotally coupled to said rod, said lever being coupled to said valve, said lever opening said valve when said lever is depressed, said lever closing said valve when said lever is released.

3. The joint compound application assembly according to claim 2, further comprising a handle being coupled to said rod for gripping said handle, said handle having a central member extending between a pair of outward members, each of said outward members being coupled to said rod having said central member being spaced from said rod wherein said central member is configured to be gripped.

4. The joint compound application assembly according to claim 1, wherein:

said second end of said rod is coupled to said back side;

said back side has a tape slot extending into an interior of said box, said tape slot being positioned beneath said rod; and said conduit has an output end, said output end being positioned in said box.

5. The joint compound application assembly according to claim 4, further comprising a tape mount being removably coupled to said rod, said tape mount including a pair of engagements each releasably engaging a respective side of a roll of tape, said tape being extendable through said tape slot in said box wherein said tape is configured to be applied to the wall or ceiling.

6. The joint compound application assembly according to claim 4, wherein said hose has a distal end with respect to said rod, said distal end being positioned in said box at a point being located beneath said tape slot.

7. The joint compound application assembly according to claim 6, further comprising a tape nozzle being fluidly coupled to said distal end of said hose wherein said tape nozzle is configured to spray the joint compound over said tape when said tape is applied to the wall or ceiling.

8. The joint compound application assembly according to claim 4, wherein said spray bar is fluidly coupled to said output end of said conduit, said spray bar having a plurality of outputs, each of said outputs being directed toward said front edge of said box wherein each of said outputs is configured to direct the joint compound onto the wall or ceiling, said outputs being spaced apart from each other and being distributed between said first lateral side and said second lateral side of said outer wall of said box.

9. The joint compound application assembly according to claim 1, further comprising a pair of rollers, each of said rollers being rotatably coupled to said box, each of said rollers rolling along the wall or the ceiling thereby facilitating a bottom side of said box to be directed toward the wall or the ceiling, each of said rollers being positioned on a respective one of said first lateral side and said second lateral side of said outer wall of said box, each of said rollers being positioned adjacent to an intersection between said sloped portion of said respective first lateral side and said second lateral side and said top wall of said box.

10. A joint compound application assembly being configured to apply joint compound and joint tape to a wall or a ceiling, said assembly comprising:

a rod having a conduit being integrated therein, said conduit being fluidly coupled to a source of joint compound thereby facilitating the joint compound to be urged through said conduit, said rod having a first end and a second end, said rod being elongated between said first end and said second end, said conduit having an input end adjacent to said first end, said input end having a fitting being fluidly coupled thereto for removably engaging the source of the joint compound;

a valve being coupled to said rod, said valve being in communication with said conduit, said valve inhibiting the joint compound from passing through said conduit when said valve is closed, said valve facilitating the joint compound to pass through said conduit when said valve is opened;

a lever being pivotally coupled to said rod, said lever being coupled to said valve, said lever opening said valve when said lever is depressed, said lever closing said valve when said lever is released;

a guard being positioned around said lever thereby inhibiting said lever from being inadvertently depressed;

a handle being coupled to said rod for gripping said handle, said handle having a central member extending between a pair of outward members, each of said outward members being coupled to said rod having said central member being spaced from said rod wherein said central member is configured to be gripped;

a box being coupled to said rod, said box having a top wall and an outer wall extending downwardly therefrom, said outer wall having a back side, a first lateral side and a second lateral side, each of first lateral side and said second lateral side having a sloped portion sloping upwardly toward said top wall to define a front edge of said box, said sloped portion of each of said first lateral side and said second lateral side being positioned against the wall or ceiling, said second end of said rod being coupled to said back side, said back side having a tape slot extending into an interior of said box, said tape slot being positioned beneath said rod, said conduit having an output end, said output end being positioned in said box;

a plurality of fasteners, each of said fasteners being coupled to and extending away from said top wall of said box;

a tape mount being removably coupled to said rod, said tape mount including a pair of engagements each releasably engaging a respective side of a roll of tape, said tape being extendable through said tape slot in said box wherein said tape is configured to be applied to the wall or ceiling;

a pair of rollers, each of said rollers being rotatably coupled to said box, each of said rollers rolling along the wall or the ceiling thereby facilitating a bottom side of said box to be directed toward the wall or the ceiling, each of said rollers being positioned on a respective one of said first lateral side and said second lateral side of said outer wall of said box, each of said rollers being positioned adjacent to an intersection between said sloped portion of said respective first lateral side and said second lateral side and said top wall of said box;

a hose being fluidly coupled to said conduit, said hose extending between said rod and said back side of said outer wall of said box, said hose having a distal end with respect to said rod, said distal end being positioned in said box at a point being located beneath said tape slot;

a spray bar being fluidly coupled to said conduit wherein said spray bar is configured to receive the joint compound, said spray bar being fluidly coupled to said outlet end of said conduit, said spray bar having a plurality of outputs, each of said outputs being directed toward said front edge of said box wherein each of said outputs is configured to direct the joint compound onto the wall or ceiling, said output being spaced apart from each other and being distributed between said first lateral side and said second lateral side of said outer wall of said box;

a tape nozzle being fluidly coupled to said distal end of said hose wherein said tape nozzle is configured to spray the joint compound over said tape when said tape is applied to the wall or ceiling;

a knife being coupled to said box, said knife positioned on said top wall of said box, said knife being coextensive with said front edge of said box wherein said knife is configured to smooth the joint compound on the wall or ceiling; and a heating unit being removably coupled to said box, said heating unit blowing heated air onto the wall or ceiling when said heating unit is turned on wherein said heating unit is configured to enhance drying the joint compound on the wall or ceiling, said heating unit engaging each of said fasteners on said top wall of said box, said heating unit having an exhaust, said exhaust being directed toward said front edge of said box wherein said exhaust is configured to direct the heated air onto the wall or ceiling.

* * * * *